US005878449A

United States Patent [19]

Belenky et al.

[11] Patent Number: 5,878,449

[45] Date of Patent: Mar. 9, 1999

[54] EARTHQUAKE-PROTECTION BED

[76] Inventors: Garry Belenky, 326 Phillip Dr., Daly City, Calif. 94015; Alexander Shkolnik, 485 Dartmouth Ave., San Carlos, Calif. 94070; Alexander Trachtenherz, Posernweg, 15, 08393 Meerane, Germany; Roman Topilov, Leninskoy Iskry Str. 6, Apt. 145, 270121, Odessa, Ukraine

[21] Appl. No.: 951,771

[22] Filed: Oct. 16, 1997

[51] Int. Cl.[6] ..... A47C 29/00; A47C 31/00

[52] U.S. Cl. ..... 5/1; 5/414; 5/424

[58] Field of Search ..... 5/1, 5, 9.1, 174, 5/121, 414, 424, 425, 128, 113; 52/68, 69

[56] References Cited

U.S. PATENT DOCUMENTS

| | | | |
|---|---|---|---|
| 2,607,047 | 8/1952 | Posey | 5/1 |
| 4,048,683 | 9/1977 | Chen | 5/174 |
| 4,069,527 | 1/1978 | Harris | 5/414 |
| 4,490,864 | 1/1985 | Wicker | 5/9.1 |
| 4,757,563 | 7/1988 | An | 5/121 |
| 4,782,541 | 11/1988 | Tuchman | 5/414 |
| 4,965,895 | 10/1990 | Shustov | 5/414 |
| 5,575,024 | 11/1996 | You | 5/414 |
| 5,615,424 | 4/1997 | Nakata | 5/414 |
| 5,662,132 | 9/1997 | Larsen | 5/424 |

*Primary Examiner*—Michael F. Trettel
*Assistant Examiner*—Fredrick Conley

[57] ABSTRACT

An earthquake protection structure for an occupant of a piece of furniture has support members (12, 14) each having a base portion 20 movable on support surface (11), and opening (24) at least partly covered by protective flap (40). Suspensions 26 is provided between support members (12; 14) and bed (10) and has pivot pins (28);(30) extending between support members (12; 14) in parallel the support members. Linkage (46–66) is provided for holding base portions (22; 22) support members (12; 14) from moving over support surface (11). The protective structure has an actuator means for causing protective flaps (40) to turn with respect to support members (12; 14) outward with respect to the space defined between them. A release mechanism is provided for releasing linkage (46–66). When it is released, the free ends of support members (12; 14) move toward each other and protective flaps (40) are caused to turn outward thus forming, in combination with the support members, a protective canopy over an occupant of bed (10).

4 Claims, 7 Drawing Sheets

EARTHQUAKE-PROTECTION BED

FIELD OF THE INVENTION

The present invention relates to furniture, particularly to beds with means for protecting bed occupants against objects falling from above, and more particularly, to an earthquake protection structure that can be used for protecting occupants of a bed or another piece of furniture against injurious effects of natural disaster factors.

DESCRIPTION OF PRIOR ART

Numerous catastrophes due to natural causes, such as earthquakes and tornadoes, or due to those caused by humans, such as explosions, and the like, can all damage dwellings. Such catastrophes may expose an occupant of a dwelling to falling debris when ceiling and upper floors fully or partially collapse. The possibility of injury, or even death, to occupants of such dwellings is very real, particularly when the catastrophe occurs during the night while occupants are asleep and there is no advance warning to permit evacuation of the dwelling. In certain regions of the world where earthquakes and tornadoes are more common, numerous injuries and deaths can occur when residents are asleep. While housing structures in such regions are generally specially designed and reinforced to be more resistant to damage and collapse, substantial damage can nevertheless occur, particularly when natural disasters are vigorous.

In hospitals, houses for elderly people, and nurseries for children, many residents remain in bed, not only in the nighttime but also in the daytime, without any ability to leave their beds when an earthquake occurs.

Meanwhile, statistics show that the probability of injuries is greatly reduced when occupants of a building have time to move to a shelter under beams, tables, furniture, or rigid elements of the building.

It has been proposed to protect sleeping occupants from unexpected earthquakes by providing a bed with a foldable earthquake protective cover which is formed by two foldable side plates (see FIG. 1 of U.S. Pat. No. 5,111,543, issued May 1992 to Yefim Epshetsky, et al.). The side plates are pivotally attached to the bed frame so that they can be turned upward manually or automatically by a drive mechanism following a signal of a seismic pickup so that in the unfolded position they form a protective cover above the bed.

A disadvantage of the bed described in the above patent is that, in the protective position of the bed, the height of the protective cover above the bed is less than the half-length of the body of the bed's occupant. This is because the height of the protective cover above the mattress is determined by the length of pivot arms supporting the side plates. Since the side plates should have a length which is less than the half width of the bed frame, the height of the protective cover above the bed would be rather short. This, in turn, may lead to an injury if in a critical moment of an earthquake the bed occupant will sharply raise his/her head and bump it against the low protective cover. Furthermore, since the automatic drive for folding and unfolding the bed should have a power sufficient to overcome friction forces and heavy weight of metal or wooden side plates, the mechanical drive during the operation may turn over a baby sitting on a bed. This may lead to an injury and will not allow the baby to easily leave the place at a critical moment of an earthquake.

In all embodiments of the bed of the above invention, the arms extend vertically in the unfolded state and cover the central side portions of the space between the mattress and the protective cover. This creates an obstacle for the bed occupant when he/she tries to leave the bed.

A serious disadvantage of the earthquake protection bed of the above U.S. patent is low stability which results from the fact that in the unfolded or protective position of the bed, its center of gravity is shifted upward to a relatively high level. This is because two heavy elements, i.e., a headboard and a foot board are turned up. While the center of gravity is shifted upward, the width of the supporting part of the bed is not increased and remains unchanged. This means that during a strong earthquake such a bed is so unstable that it may turn over even because of jolts, to say nothing about heavy falling objects.

When a heavy object falls onto an edge of a pivotally supported element of the protective cover of the aforementioned earthquake protective bed, an impact developed by the falling object and its weight may develop a moment sufficient to turn over this element of the protective cover to its folded position. Alternatively, the falling heavy object may turn over the entire bed in view of its low stability. This reduces reliability of the protective structure.

OBJECTS AND ADVANTAGES OF THE INVENTION

It is therefore an object of the invention to eliminate the above disadvantages and to provide an earthquake protection structure which forms a rigid and reliable protective cover over an occupant of a bed, provides, in the protection position, a space above the occupant's head sufficient for sitting in the bed, prevents possibility of injury during folding and unfolding, and prevents the support members of the cover or the entire bed from being turned over under the effect of falling objects; to provide the above-mentioned protection structure which is stable in the protection position; to provide the above protection structure with a relatively low position of the center of gravity; to provide a larger span between the support members during the unfolding; and to provide for a free and convenient exit from the protection structure in its protection position. Other advantages and features of the invention will become apparent from a consideration of the ensuing description and drawings.

DETAILED DESCRIPTION OF THE APPARATUS OF THE INVENTION

Figure 1:
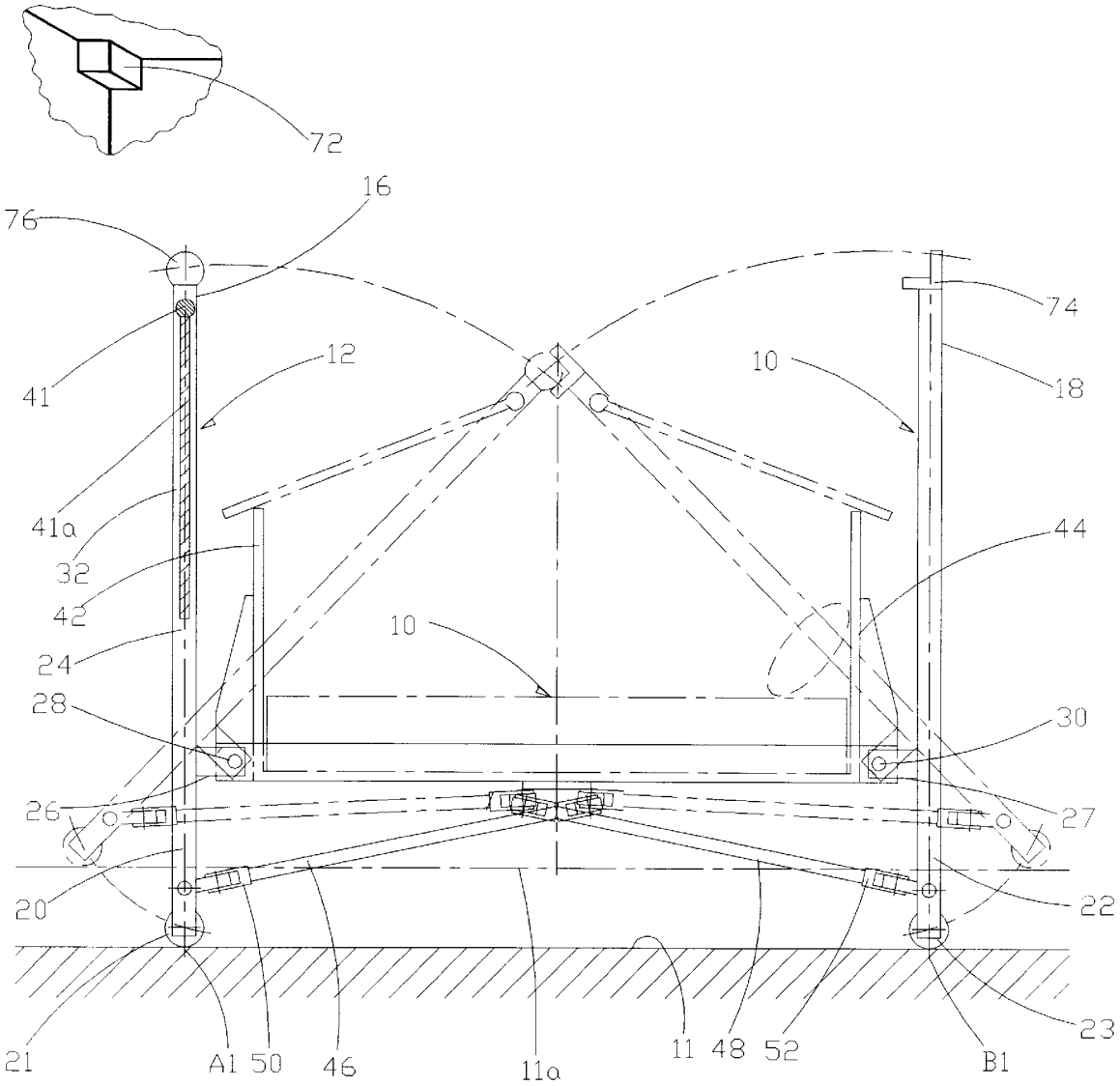
FIG. 1 is a schematic side view of an earthquake protection structure for an occupant of a piece of furniture according to the invention in normal position.

An earthquake protection structure of the invention designed for protecting an occupant of a piece of furniture, e. g., a bed 10, is shown in FIG. 1 which is a schematic side view of the structure in its normal condition. The earthquake protection structure has a first support member 12 and a second support member 14 spaced from each other to define a space between them for the accommodation of bed 10 or another piece of furniture to be protected. Support members 12 and 14 each has a free end 16, 18, respectively, a base portion 20, 22, respectively, movable on a support surface 11, and an opening 24 (FIG. 2) extending lengthwise of the support members between their free ends and base portions, respectively. Suspension means 26, 27 are provided between each support member 12, 14 and bed 10 for suspending the bed from the support members 12 and 14. This means that bed 10 (or another piece of furniture) does not rest upon support surface 11 (e. g., the floor of a room), but is rather suspended from support members 12 and 14. Suspension means 26, 27 have first and second pivot pins 28, 30, respectively for a pivotal connection between bed 10 and first support member 12 and second support member 14, respectively. This facility permits support members 12 and 14 to turn with respect to bed 10. Pivot pins 28, 30 extend in parallel with first and second support members 12 and 14 and are located within the space defined between the support members.

It is understood that with this arrangement of pivot pins 28, 30, the force of gravity of bed 10 generates a tilting moment with respect to points A1, A2 and B1, B2 (FIGS. 1, 2, 3; point B2 is not seen), where portions 20, 22 of support members 12, 14 rest upon support surface 11. Base portions 20, 22 and hence points A1, A2, B1, B2 are moveable over support surface 11. For this purpose, they can be provided with any device facilitating such movement, e. g., with casters 21, 23.

Figure 2:
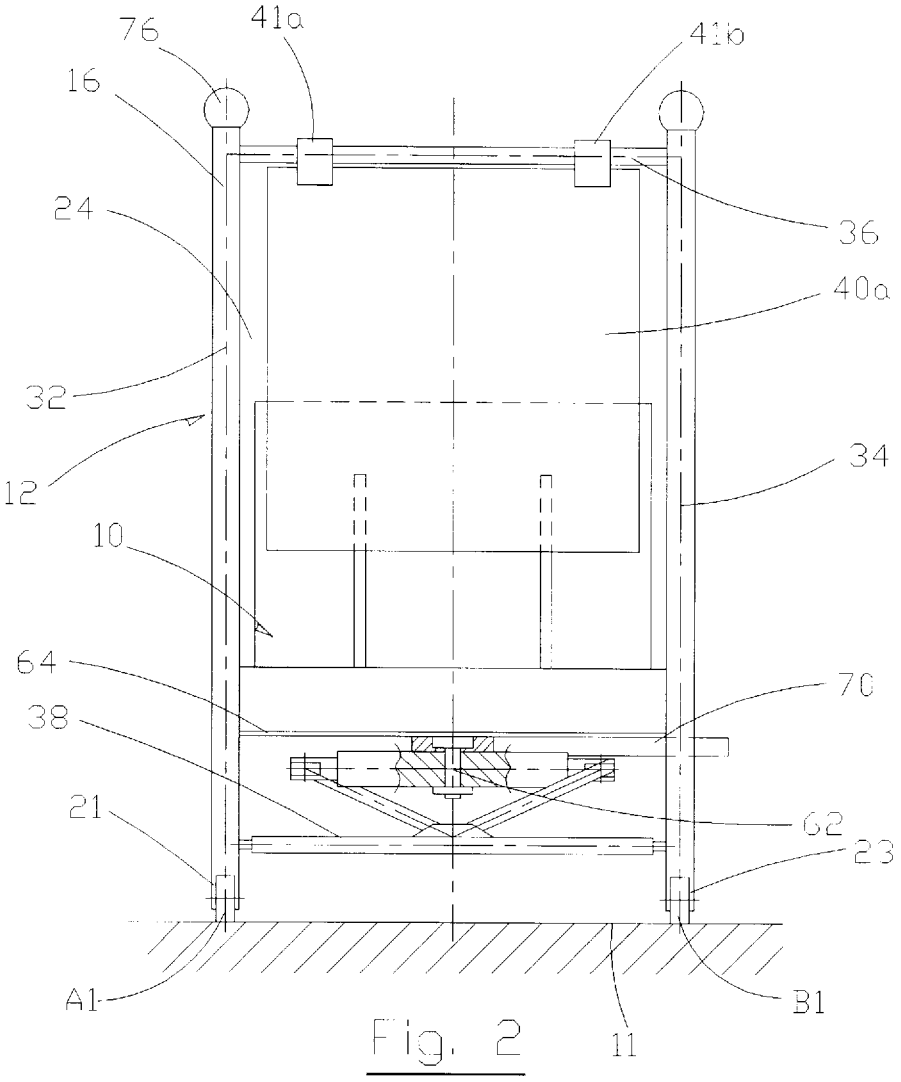
FIG. 2 is an end view of the earthquake protection structure shown in FIG. 1.
Figure 3:
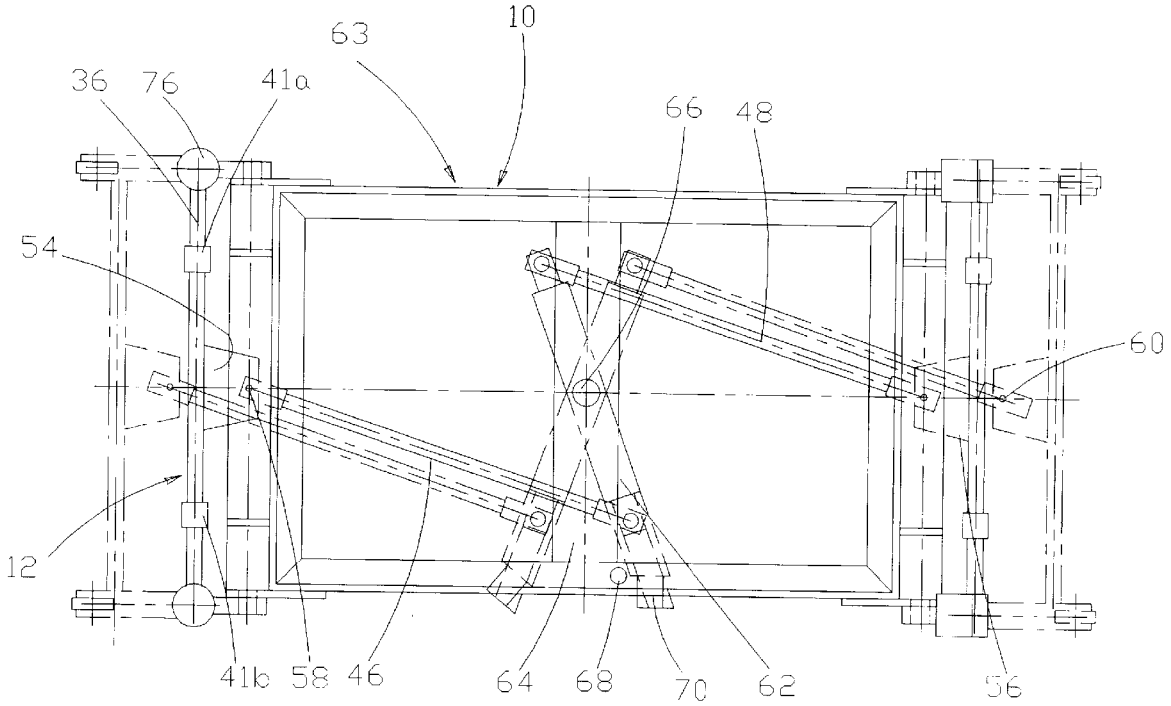
FIG. 3 is a top view of the earthquake protection structure shown in FIG. 1.

Each of first and second support members 12 and 14 may consist of a first column 32 and a second column 34 (FIG. 2) interconnected by tie rods 36, 38 to form a support member structure. It is understood that both first and second support members 12, 14 are identical so that this description applies equally to both of them. A protective flap 40*a* (40*b*—on the other side of the structure) is provided in opening 24 of support structure 12 (FIGS. 1, 2). Protective flap 40 extends between free end 16 and base portion 20 of support 12 and is pivotally connected at 41*a* and 41*b* to tie rod 36 so that it is free to turn in opening 24. Protective flap 40 at least partly covers opening 24. Bed 10 has vertical posts 42, 44 (FIGS. 1, 2) that can be connected to the headboard and footboard of bed 10 to define an actuator means for turning protective flaps 40 as will be described later.

Support members 12 and 14 are held against movement over support surface 11 when the protection structure is in its normal position. This is accomplished by means of a linkage having a first tie rod 46 and a second tie rod 48. First and second tie rods 46, 48 have their respective first ends 50, 52 pivotally connected to first and second support members 12 and 14, respectively. For that purpose, first and second support members 12, 14 have brackets 54, 56 (FIG. 3) with pivot pins 58, 60, respectively, for supporting tie rods 46, 48. In this manner, tie rods 46, 48 can turn with respect to support members 12, 14.

Figure 3A:
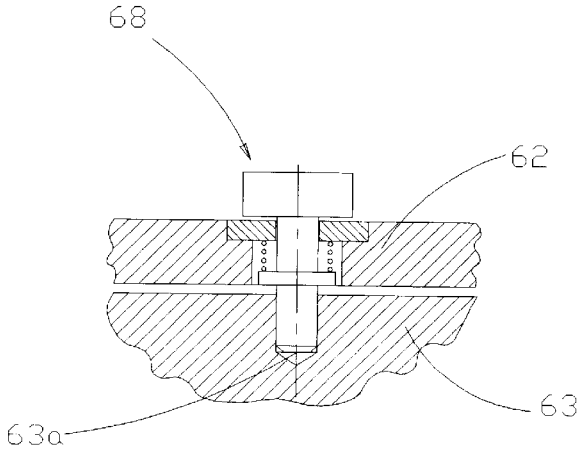
FIG. 3A is a fragmental sectional view of a releasable stop used to immobilize a rotatable link.

The linkage also has a rotatable link 62 mounted on a cross piece 64 of a frame 63 of bed 10 by means of a pivot pin 66. Two ends of rotatable link 62 are pivotally connected to the second ends of first and second tie rods 46, 48, respectively. It is understood that with this arrangement of tie rods 46, 48 and rotatable link 62, the tie rods will cause rotatable link 62 to turn on pivot pin 66, whereby base portions 20, 22 of support members 12, 14 (FIG. 1) move over support surface 11. To prevent this movement in the normal position of the protection structure and bed 10, a releasable stop 68 (FIG. 3A) is provided, e. g., in frame 63 of bed 10, which is engageable with rotatable link 62 to hold it against rotation. A specific construction of such releasable stop 68 does not have any material bearing on this invention. It can be made, e.g., in the form of a latch with a spring-loaded pin 62*a* (FIG. 3A) insertable into a hole 63*a* in bed frame 63 or any other manually-activated device. What is important is that this stop 68 connects rotatable link 62 to bed frame 63. As a result, tie rods 46, 48 are immobilized, and base portions 20, 22 of support members 12, 14 cannot move over support surface 11 under force of gravity of bed 10 and its occupant. It is understood that releasable stop 68 can be release by hand. Rotatable link 62 can have a handle 70 for returning the system to the initial position. Releasable stop 68 can also be in the form of an electrically or mechanically actuated device connected to a control unit coupled to a seismic pickup 72, located, e.g., in a corner of a room as shown in FIG. 1. Such control unit, actuator and pickup coupling devices are not shown here because they do not have material bearing on this invention. It is understood that a system of such type can function following an earthquake signal from seismic pickup (not shown) to release releasable stop 68 so as to allow rotatable link 62 to turn on pivot pin 66.

Bed 10 is used in a normal way for its direct purpose, e.g., as a sleeping bed or a hospital bed.

In case of an earthquake, rotatable link 62 is released either by manually releasing stop 68 or following a signal from seismic pickup 72 fed to a control unit and an actuator (not shown) to release stop 68. When rotatable link 62 is free to turn, tie rods 46, 48 can move freely under the action of support members 12, 14 having their base portions 20, 22 moving over support surface 11 on casters 21, 23 (FIG. 1). This movement occurs under the action of the forces of gravity of bed 10 (and its occupant) because these forces are applied to suspension means 26 in the off-center position with respect to support members 12, 14. As a result, base portions 20, 22 of support members 12, 14 move outwardly with respect to the protectable space, and their free ends 16, 18 move to meet each other as shown by dotted lines in FIG. 1 (in thisd position, support surface 11 is shown in FIG. 1 with dash-and-dot line 11*a*).

Owing to the provision of tie rods 46, 48 and rotatable link 62, the support members will move in a timed fashion. Free ends 16, 18 of support members 12, 14 will come to engage each other, and a strong triangular protective structure is thus formed. Mating stop members such as an angle iron 74 and ball 76 can be provided at the ends of columns 32, 34 of support structures 12 and 14, respectively to ensure a good engagement. During movement of support members 12, 14 to their new inclined position, posts 42, 44 will come to bear against protective flaps 40 that will turn outside with respect to the protectable space thus forming a protective tent over the occupant of the bed.

Figure 4:
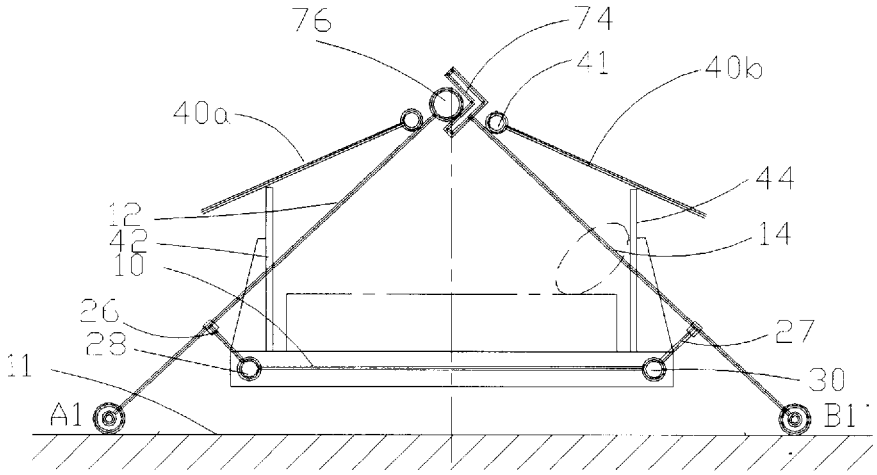
FIG. 4 is a diagrammatic side view showing the protection structure according to the invention in the protection position.

The protection structure is shown schematically in its unfolded or protection position in FIG. 4. If some debris or parts of a building structure fall down, the bed and its occupant will be protected against their injurious effects by the protective structure made up of the inclined support members and protective flaps. It is understood that the space under protective flaps 40 is large enough because its size is not determined by the size of support members 12, 14. When the emergency is over, the protection structure and the bed can be returned to the initial normal position by elevating the bed and/or moving the support members apart and locking releasable stop 68 to immobilize rotatable link 62.

Figure 5:
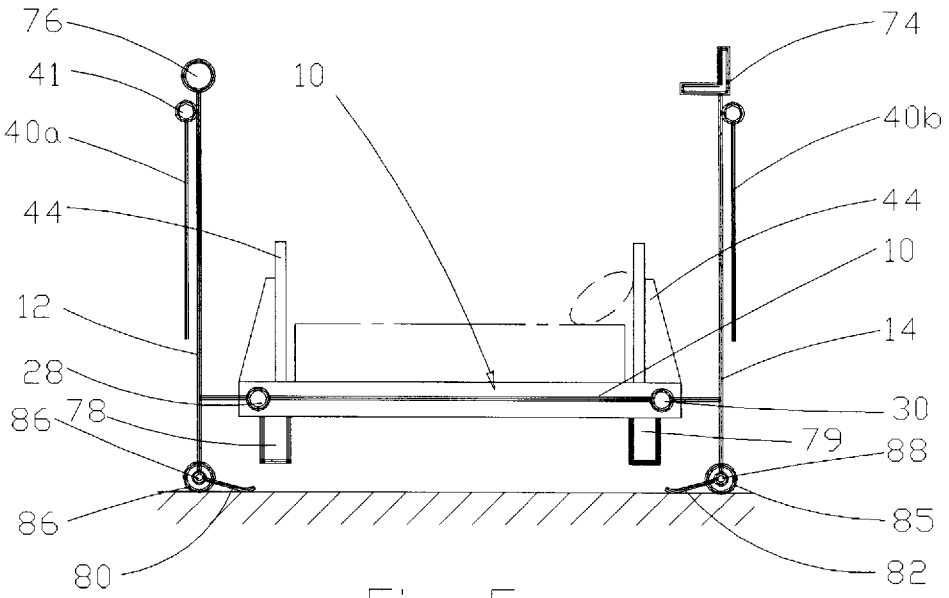
FIGS. 5 through 7 show diagrammatic side views of the protection structure in its normal position, in an intermediate position, and in the protection position, respectively.
Figure 6:
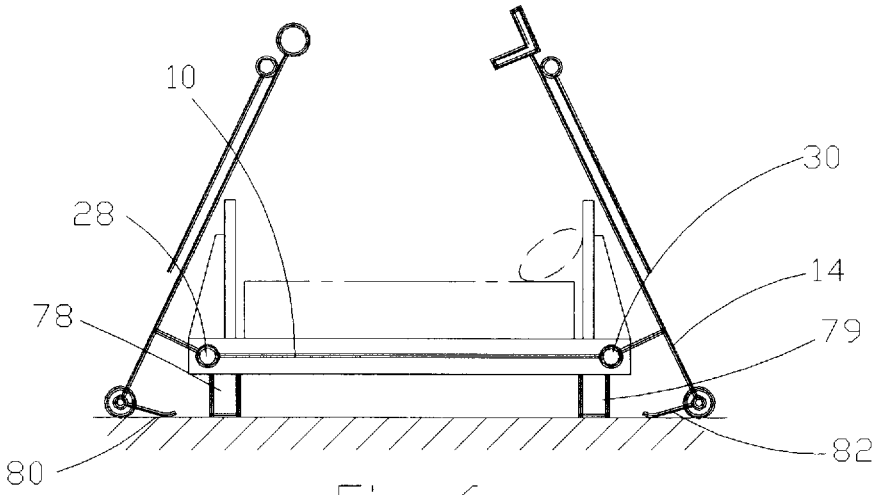
Figure 7:
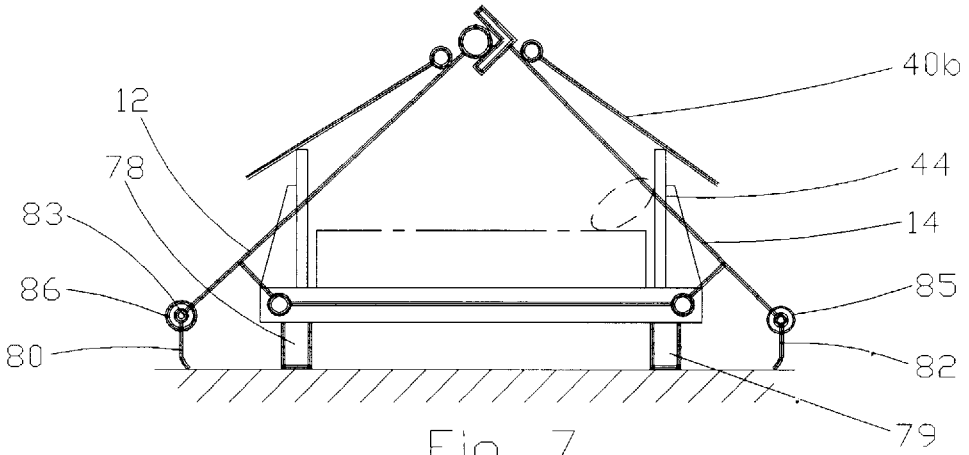

In another embodiment, schematically shown in FIGS. 5 through 7 in which identical parts are designated by the same reference numerals as in FIG. 4 above, the difference resides in that bed 10 has supports 78, 79, and support members 12, 14 are made respectively shorter. In this case when bed 10 comes to rest upon support surface 11 through its supports 78, 79 as a result of movement of support members 12, 14 over the support surface as described above, the support members will be in the inclined position as shown in FIG. 6 and will move to meet each other under their own gravity. Pivotal stops 80, 82 provided at the base portions 83, 85 of the support members on pivot pins 86, 88, respectively, will be caused to move to the vertical position shown in FIG. 7. This provides for the formation of a rigid protection structure.

In an embodiment shown in FIGS. 8 through 11, an earthquake protection structure is generally similar to that described above. This embodiment allows the protective structure to be made more compact so as to fit an interior design.

Figure 8:
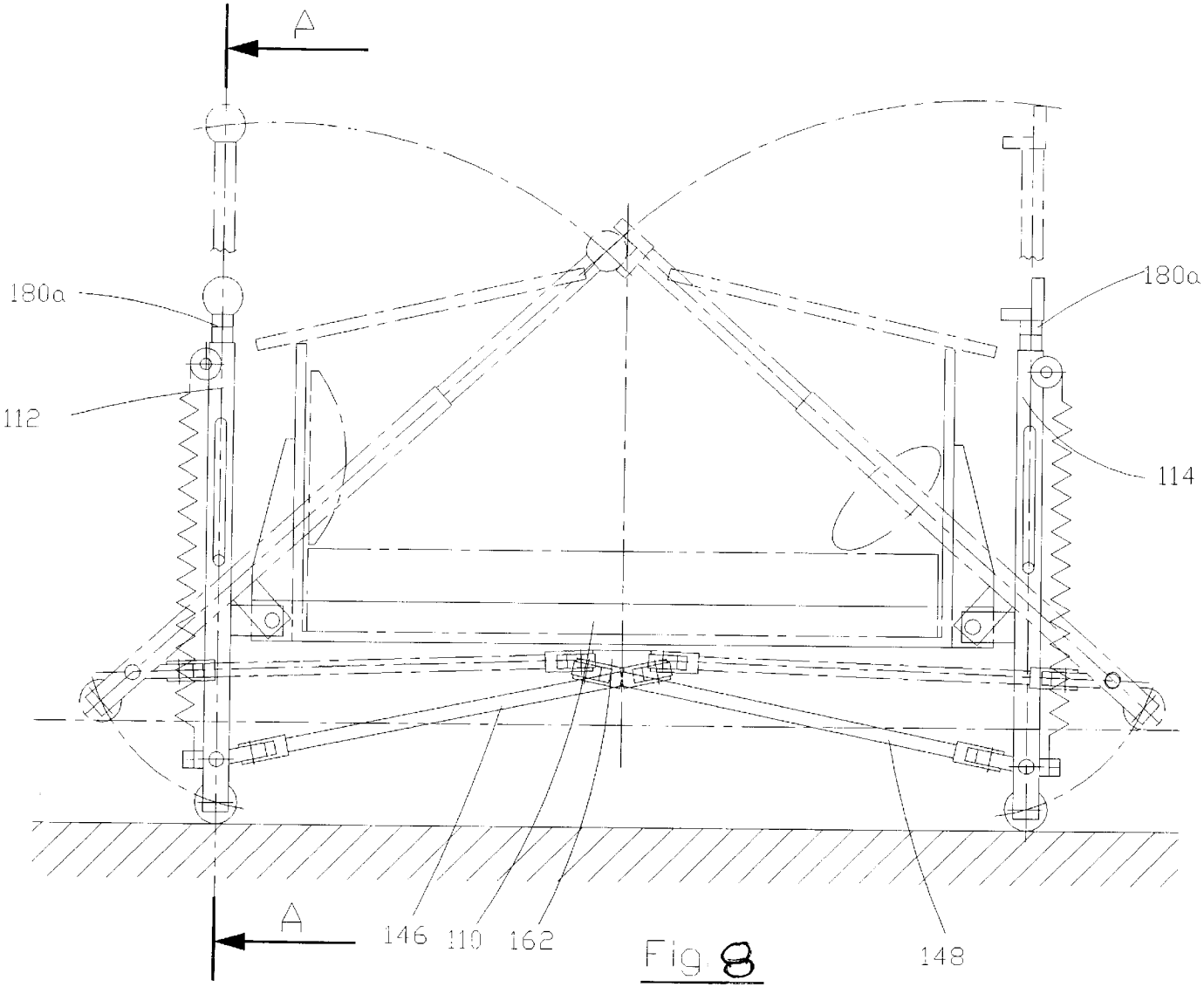
FIG. 8 is a schematic side view of another embodiment of an earthquake protection structure for an occupant of a piece of furniture according to the invention in the normal position.
Figure 9:
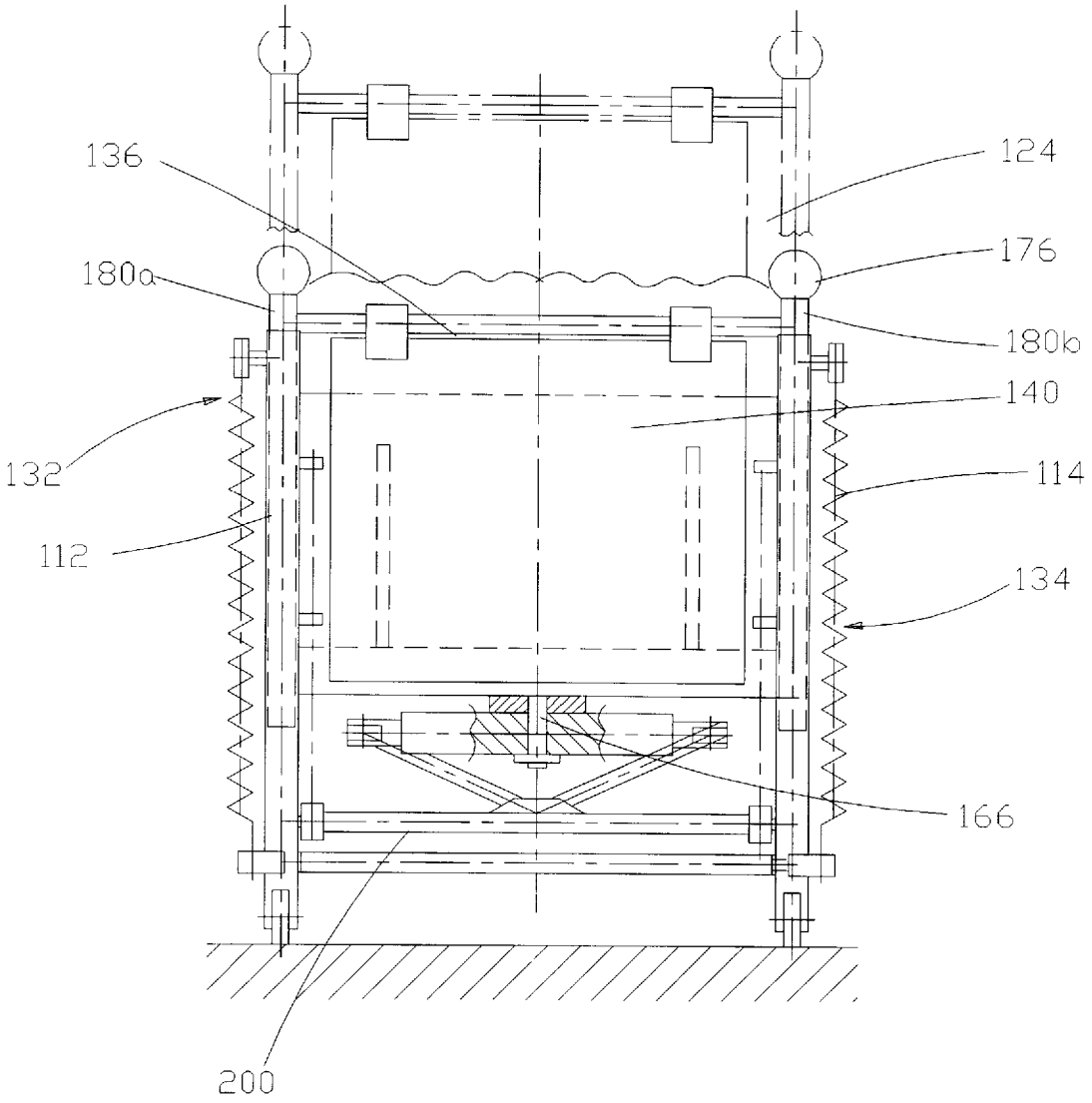
FIG. 9 is an end view of the structure shown in FIG. 8.

As shown in FIGS. 8, 9, support members 112, 114 are made in the form of hollow columns 132, 134 and have telescopic extension rods 180*a,* 180*b* on one side of the structure and 182*a,* 182*b* on the other side of the structure. These rods are axially movable in the columns. Each column has two longitudinally extending substantially opposed slots 184, 186 (FIG. 10), and each telescopic extension rod has a drive pin 190 secured to the extension rod and extending through slots 184, 186. An energy storage means such as an expansion spring 192 has one end connected to one end of drive pin 190, e. g., by means of a rope 196 and a pulley 198 mounted on column 132. The other end of spring 192 is connected to base portion 120 of column 132. A shaft 200 is mounted for rotation between two hollow columns 132 (only one is shown), and has a rope 202 attached to and wound on it. The other end of this rope is attached to drive pin 190. In the initial or normal position, spring 192 is stretched by rotating shaft 200 by means of a wrench or a handle (not shown) so that telescopic extension rods 180 could move into the hollow columns (rope 202 is wound on shaft 200).

Figures 10, 11:
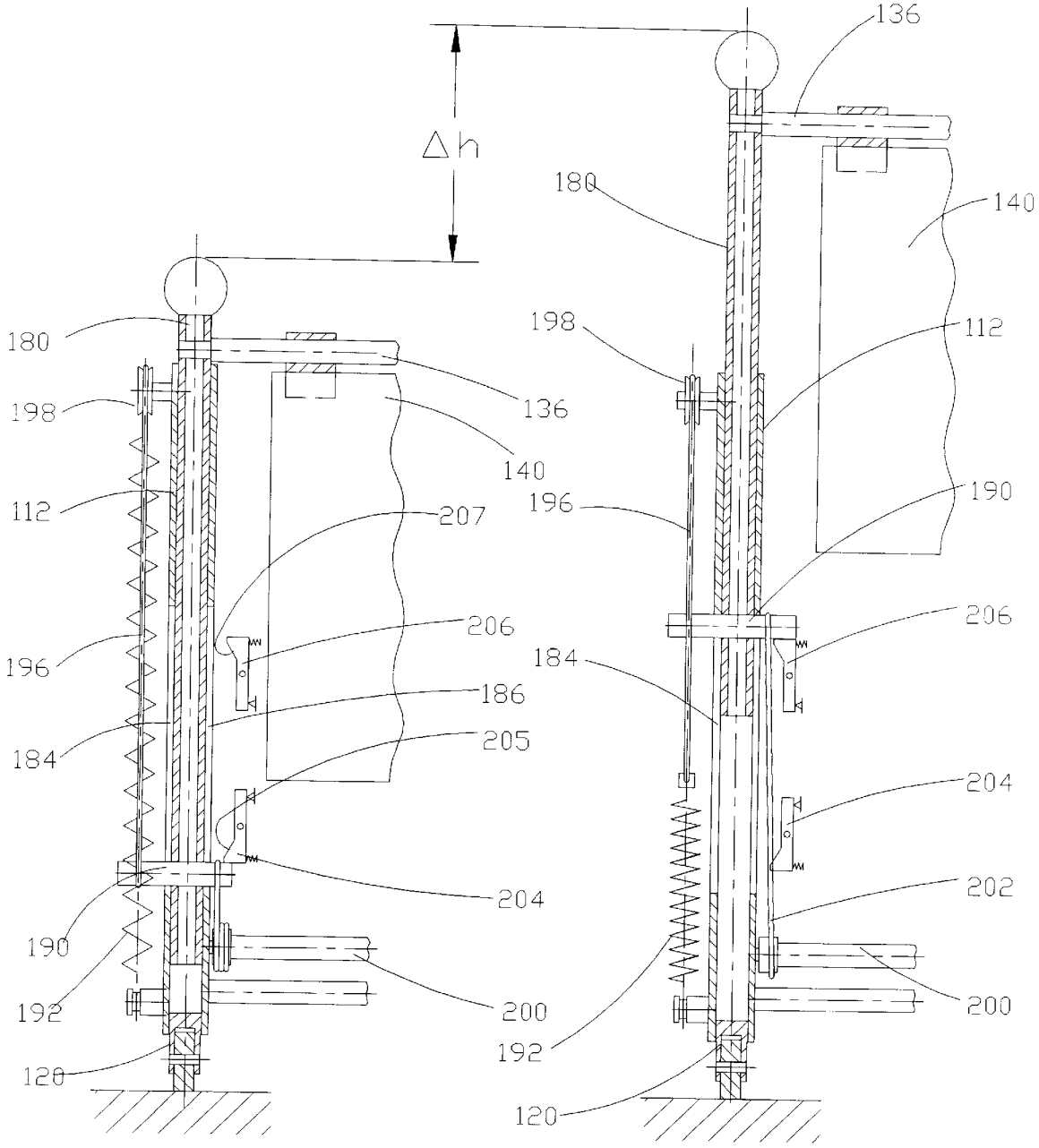
FIG. 10 is a partial end view of the earthquake protection structure of FIG. 8 in a normal position.
FIG. 11 is a partial end view of the earthquake protection structure of FIG. 8 before unfolding to the protection position.

To fix the extension rods in this position, there is provided a releasable locking device 204 that does not allow drive pin 190 to move. Another spring-loaded locking device 206 is provided in a spaced relation to locking device 204 lengthwise of hollow column 132. As shown in FIG. 10, the locking devices have opposed cam faces 205, 207. It is understood that locking device 204 can have the above-described connection to a seismic pickup or it can have a manually operated actuator to be released in the event of an earthquake. In the former case, a special delay circuit can be provided so as to delay actuation of releasable stop 68 described in connection with the first embodiment (not shown here) until after the release of locking device 204. An appropriate system for such seismic pickup connection is not shown herein as it does not have any material bearing on this invention and is well known in the art.

To actuate the protection structure, locking device 204 of each column is first released to allow drive pin 190 to move in slots 184, 196 under the action of expanded spring 192. As a result, telescopic extension rods 180 will move out of the hollow columns to the full length as shown in FIG. 11. In this position, drive pin 190 is held by locking device 206. Owing to the provision of shaft 200, movement of the two extension rods in each support member 112, 114 is synchronized, and they move simultaneously to lift cross piece 136 that carries protective flap 140. When telescopic extension rods 180 are extended, the linkage consisting of tie rods 146, 148 and rotatable link 162 is resealed (as described with reference to FIGS. 1 to 3), and the protection structure is caused to move to the protection position under the force of gravity of bed 110 as described above with reference to FIGS. 1 through 3. For the rest, this embodiment is the same as the one described earlier.

Although the invention was described with reference to specific embodiments illustrated in the accompanying drawings, it will be apparent that various modifications can be made without going beyond the spirit and scope of protection as defined in the appended claims. Thus, various other mechanisms can be used to time the movement of the support members that can be interconnected, e. g., by a rope and pulley mechanism having a clutch on one of the pulleys. The telescopic extension rods can be actuated hydraulically and/or electrically. The structural members of the bed and the protective structure may have cavities for storing preserved food, water, radio transmitter, or other items valuable in emergency situations.

We claim:

1. An earthquake-protective bed comprising:

a bed having vertical posts on opposite sides of said bed;

a first support member and a second support member resting upon a support surface and spaced from each other to define a protectable space therebetween for the accommodation of said bed, each of said first and second support members having a free end and a base portion movable on said support surface, said first and second support members each having an opening that extends lengthwise of each of said first and second support members between said free end and said base portion;

means for holding said base portion of each of said first and second support members from moving over said support surface;

an actuator means installed on said bed for causing said first and second support members to turn for moving said free ends toward each other to cover said protectable space; and a release means for releasing said means for holding said base portion of each of said first and second support members from moving over said support surface, whereby said free end of said first support member move toward said free end of said second support member so that said first and second support members form a protective canopy over said bed, suspension means provided between each of said first and second support members and said bed for suspending said bed from said first and second support members, each of said first and second support members having a protective flap pivotally connected to each of said first and second support members, respectively, intermediate said free end and said base portion of each of said first and second support members, each said protective flap at least partly covering said opening of each of said first and second support members, respectively;

at least one of said first and second support members comprising two hollow columns, a telescopic extension rod received in each of said two hollow columns, and a drive means for extending said telescopic extension rod from each of said two hollow columns.

2. The earthquake-protective bed of claim 1, wherein a pivotal stop is provided at said base portion of each of said first and second support members, said pivotal stop being pivotally connected to said base portion and having a free end, said free end of said pivotal stop being located inside said space between said first and second support members.

3. The earthquake-protective bed of claim 1, wherein said means for holding said base portion of each of said first and second support members from moving over said support surface comprises a linkage having a first tie rod and a second tie rod, each said tie rod has a first end and a second end, said first ends of said tie rods being pivotally connected to each of said first and second support members, respectively, a rotatable link on said bed having two ends, each of said two ends of said rotatable link being pivotally connected to said second ends of said first and second tie rods, respectively, and a releasable stop means engaged with said rotatable link to hold said rotatable link against rotation.

4. The earthquake-protective bed of claim 1, wherein each of said two hollow columns has a first longitudinal slot and a second longitudinal slot extending in a substantially diametrically opposed relation to said first longitudinal slot, said drive means comprises a drive pin secured to said telescopic extension rod and having a first end and a second end that extend through said first and second longitudinal slots, an energy storage means coupled to said first end of said drive pin, and releasable stop means engageable with said second end of said drive pin.

* * * * *